US006034861A

United States Patent [19]

Meiners et al.

[11] Patent Number: 6,034,861

[45] Date of Patent: Mar. 7, 2000

[54] FOUR-POLE TO THREE-POLE BUSSING FOR A NETWORK PROTECTOR

[75] Inventors: Steven E. Meiners, Beaver Falls; Michael F. Magazine, Adah; Douglas M. Brandt, Ellwood City, all of Pa.

[73] Assignee: Eaton Corporation, Cleveland, Ohio

[21] Appl. No.: 09/197,842

[22] Filed: Nov. 23, 1998

[51] Int. Cl.[7] ..... H01H 73/00

[52] U.S. Cl. ..... 361/115; 361/62; 335/8

[58] Field of Search ..... 361/62, 115, 611, 361/624, 637; 335/8

[56] References Cited

U.S. PATENT DOCUMENTS 4,383,146 5/1983 Bur ..... 200/17 R

OTHER PUBLICATIONS

Network Protectors type CM 22 for Heavy Load Density Areas, Descriptive Bulletin 35–550, Westinghouse Electric Corporation, Mar. 1964.

CMD Network Protector, Descriptive Bulletin 35–552 D WE A, Westinghouse Electric Corporation, Sep., 1975.

Instructions for Type CMD–1875A Network Protectors, Westinghouse Electric Corporation, May 1975.

*Primary Examiner*—Michael J. Sherry
*Attorney, Agent, or Firm*—Martin J. Moran

[57] ABSTRACT

A network protector system is provided in which the internal bussing of the network protector enclosure is constructed to adapt a four-pole circuit breaker for a three-pole network protection operation. This is provided by joining the central two bus conductors of the four line transformer input busses to make a single stab connection which interconnects with two central poles of the four-pole circuit breaker. The load output of the four-pole circuit breaker is interconnected with are overlapping stab which in turn is connected to a signal output bus bar so that the network protector system essentially converts a four-pole circuit breaker and line transformer system to a three-pole output system.

4 Claims, 4 Drawing Sheets

FOUR-POLE TO THREE-POLE BUSSING FOR A NETWORK PROTECTOR

BACKGROUND OF THE INVENTION

1. Field of the Invention

The subject matter of this invention is related to network protectors, generally and bussing systems for network protectors, specifically.

2. Description of the Prior Art

Network protectors are known. A network protector is special kind of circuit breaker, it generally consists of an automatic electrically operated circuit breaker which includes a tripping mechanism, suitable control equipment and network relays. The entire operation of the protector is usually controlled by two relays; a master relay and a phasing relay. A third relay is sometimes required to provide against unnecessary protector operations due to regenerative loads or temporary surge currents.

Low voltage AC networks assure high service continuity and heavy load density in downtown areas, for example. In the low voltage networks, the secondary mains of transformers are connected together through the network and consumer services are supplied from these mains. Power is supplied to the network mains through network transformers and network protectors located at the junctions of the network mains in a grid or at major load points around a secondary loop. The network transformers are supplied from two or more primary feeders with adjacent transformers being connected to different feeders. When one feeder is out of operation, the load continues to be fed by transformers connected to the remaining primary feeds. Consequently, customers' service is supplied from at least two different directions. Services supplied from a transformer location have a minimum of three paths of supply. Because of these multi-paths for load currents, abrupt changes in load, such as motor starting currents, cause much less voltage disturbance then on a radial system. Network protectors are often designed to assure service continuity in 125/216 and 277/480 volt Y-connected secondary network systems. These are commonly used in high load densities as in metropolitan and suburban business districts.

Understanding the construction and use of network protectors maybe found in the following publications, which are also incorporated herein by reference: "Network Protectors type CM-22 for heavy load density areas", Descriptive Bulletin 35-550 published by the Westinghouse Electric Corporation, Switchgear Division, East Pittsburgh, Pa. dated March, 1964. "CMD Network Protector" Descriptive Bulletin 35-552 D WE A published by the Westinghouse Electric Corporation, Switchgear Division dated September 1997 and "Instruction for Type CMD-1875A Network Protectors" published by the Westinghouse Electric Corporation dated 1975.

Network protectors are often found in dust proof or moisture proof enclosures, which are often disposed in passageways and runs in underground utility systems in large metropolitan areas. In many cases the circuit breaker element of the network protector is a four-pole circuit breaker, whereas the external terminals of the entire network protector system for the loads are three-pole. It is thus necessary somewhere within the network protector system to provide a transition between a four-pole system and a three-pole system. Until now this has been accomplished within the circuit breaker element of the network protector system. There are certain disadvantages associated with this solution. Most circuit breakers are already densely packed, metal enclosed devices with little or no room for welded or bolted internal connections. Furthermore, it is time consuming and expensive to adapt four-pole circuit breaker systems to three-pole applications by making changes within the circuit breaker casing. It would be advantageous therefore if a way could be found to utilize a network protector system, which had a capability of interconnection with a four-pole breaker but which nevertheless did not have the disadvantage associated with making the transition between a four-pole system and a three-pole system within the circuit breaker casing per say.

SUMMARY OF THE INVENTION

In accordance with the invention a network protector is taught which comprises an enclosure and separate conducting apparatus disposed within the enclosure. A multi-pole circuit breaker, such as a four-pole circuit breaker is disposed within the enclosure and includes terminals for interconnection with the aforementioned separate conducting apparatus. The enclosure itself has less external terminals, such as for example, three terminals for internal interconnection with the aforementioned separate conductors and external connection with an electrical load, for example. The separate conductors has one conductor thereof which interconnects with two of the four output terminals of the circuit breaker at one end thereof and internally connects at another end or portion thereof with one of the three external terminals of the enclosure, thus successfully transition between a four-pole and a three-pole system within the network protection enclosure but yet outside of the circuit breaker.

DESCRIPTION OF THE PREFERRED EMBODIMENT

Figure 2:
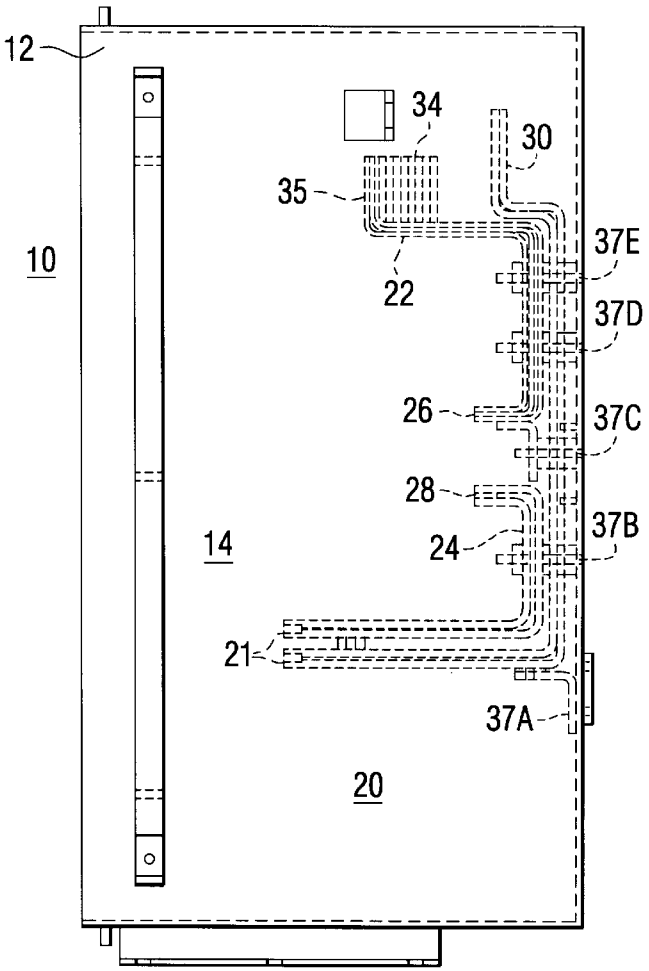
FIG. 2 PRIOR ART
FIG. 2 shows the system and enclosure of FIG. 1 in side elevation.
Figure 1:
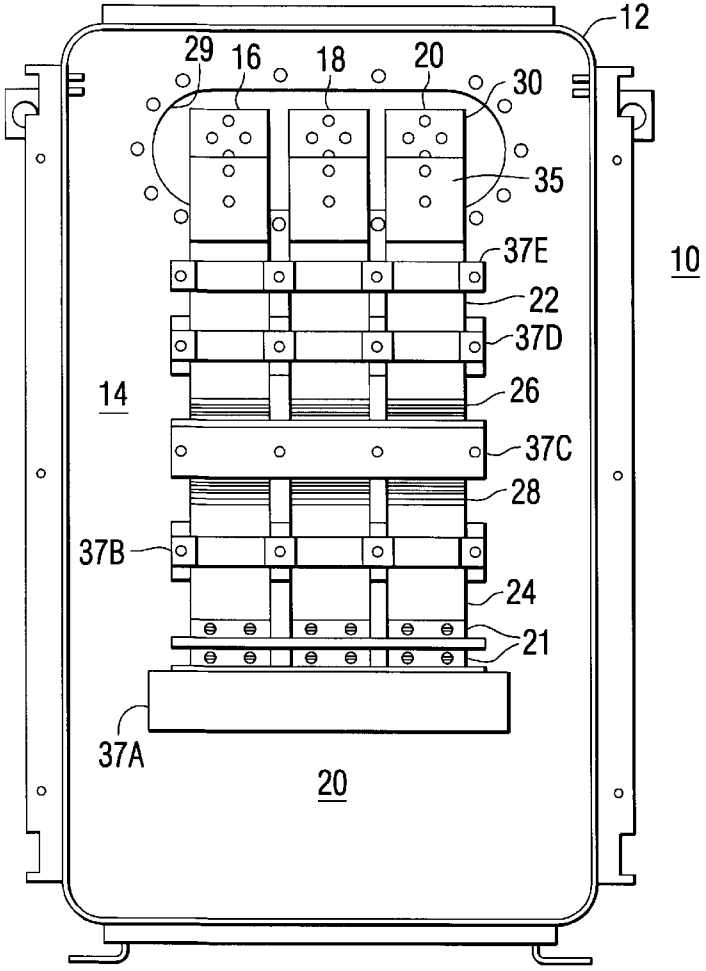
FIG. 1 PRIOR ART
FIG. 1 shows a prior art, front elevation of a three-pole internal conductor system and enclosure for a network protector circuit breaker.

Referring now to FIGS. 1 and 2, portions of a prior art network protector system 10 are depicted. In particular there is provided an enclosure 12, which through shown without a front cover, may be adapted to be dust proof or water proof by the use of a cover. There is shown internal of the enclosure 12 an internal, three-phase bussing system 14 with vertically oriented busses 16, 18 and 20. All of the vertical busses are essentially the same. Bus system 20 (FIG. 2) shows an arrangement of an exemplary prior art bussing system. There is provided a load bus 22 interconnected with a stab 26. There is also provided a line terminal bus 24 interconnected with a stab 28. Line terminal bus 24 is interconnected via a shortable open circuit arrangement 21 with a transformer line terminal 30. A shorting conductor may be disposed across the arrangement at 21 for internally connecting the remainder of the internal system with the line terminal 30. Alternately, the gap of arrangement 21 may be left open for isolating the line terminal 30 from the remainder of the internal portion of the bus system. There is provided on the load bus 22 a heat sink 34 and load terminal 35. The bussing system may be interconnected mechanically with the enclosure 12 via support and interconnection members 37A through 37E. There may be provided a sealable opening 29 in the rear of the enclosure 12 for interconnecting transformer terminals from an external line transformer with bus line terminal 30.

Figure 3:
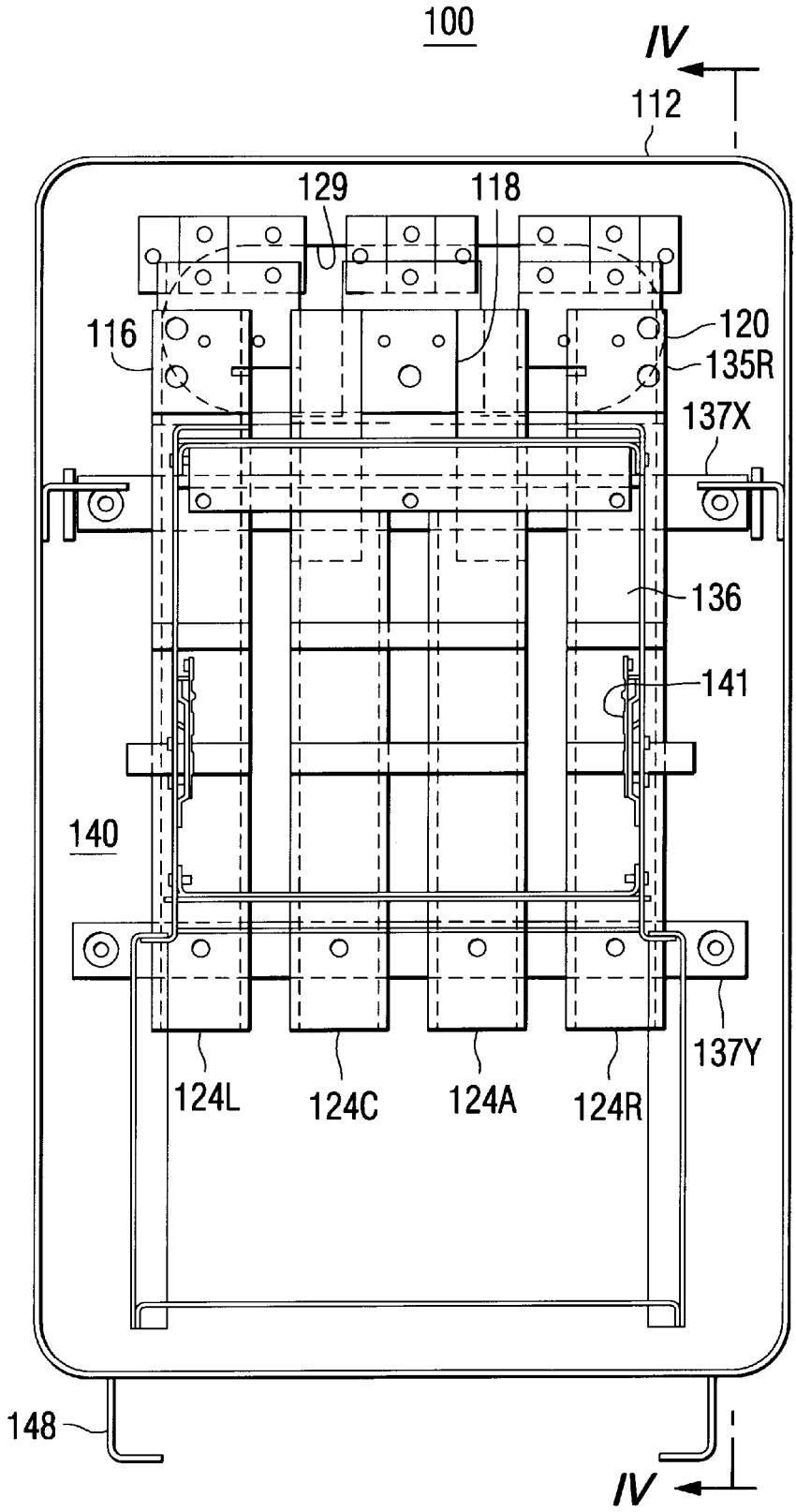
FIG. 3 shows a view similar to FIG. 1 but for an embodiment of the present invention.
Figure 4:
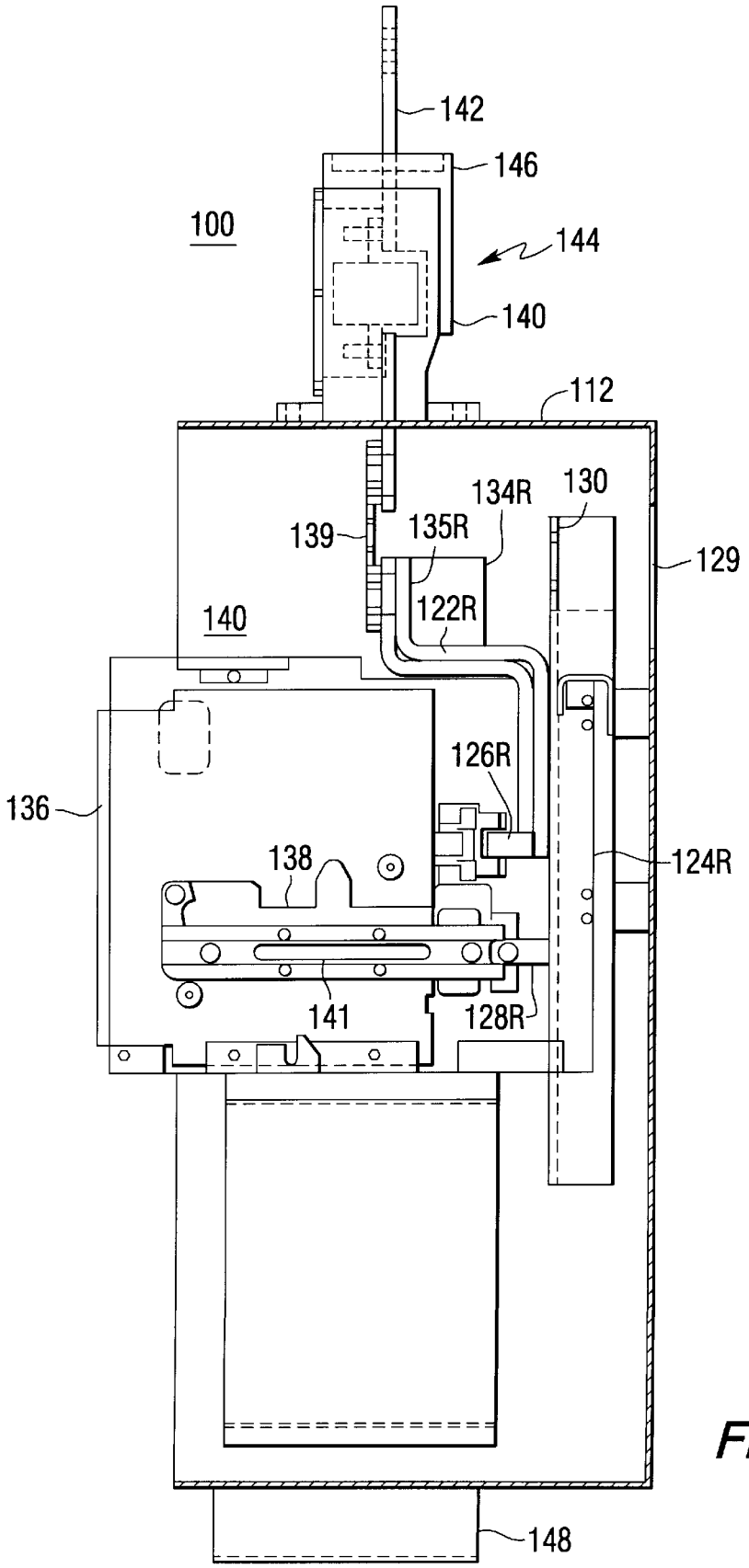
FIG. 4 shows a side elevation similar to FIG. 2 but for the embodiment of FIG. 3 as viewed along section lines IV—IV.
Figure 5:
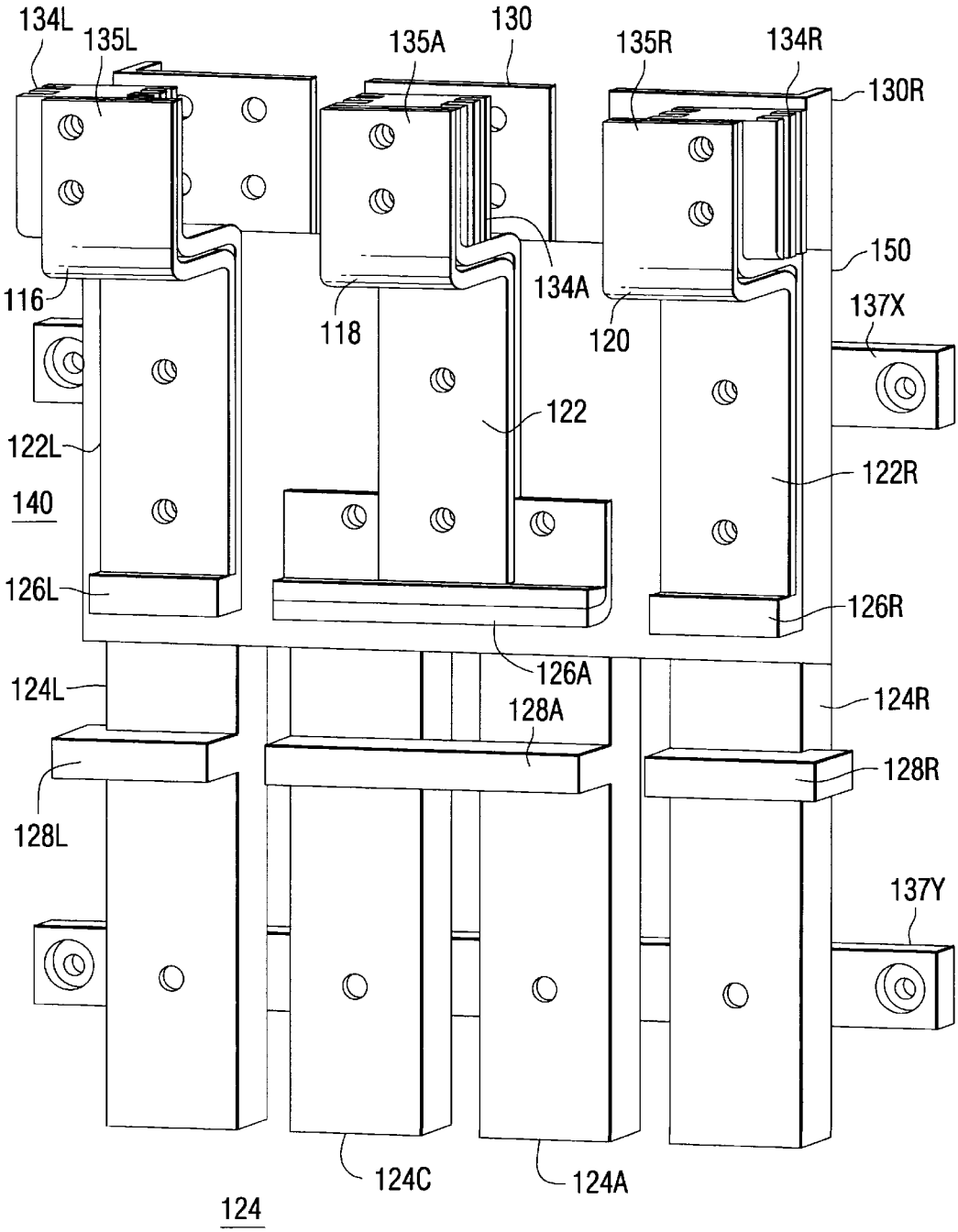
FIG. 5 shows an orthogonal view of a portion of the conductor system of FIGS. 2 and 3, specifically focusing on the internal conductor system.

Referring now to FIGS. 3, 4 and 5 an embodiment of the present invention is shown. In particular there is provided a network protector 100 comprising an enclosure 112 (FIGS. 3 and 4) having a bussing system 140 disposed internally thereof. There are provided three busses 116, 118 and 120. There is a load bus 122 (FIG. 5) interconnected with a load stab 126A. There are a line busses 124L, 124C, 124A and 124R) interconnected with tabs 128L, 128A and 128R in a manner to be described. The line bus 124R for instance, terminates in a line terminal 130R, which may be interconnected with a line transformer (not shown) via the sealable opening 129 (FIGS. 3 and 4). The load terminal 135R has disposed there about a heat sink 134R. The load terminal 135R is interconnected by way of a load bridge 139 (FIG. 4) with a load external terminal 140 for the enclosure 112. Load bus 122 terminates in a load terminal 135A (FIG. 5). A transformer 144 may be disposed within the terminal region 140 and may be surrounded by a insulator 146. Depending outwardly from the insulator 146 may be an external load terminal 142. A metal clad or metal enclosed circuit breaker 136 may be disposed upon movable rails 141 for being moved into and out of the enclosure 112 in a disposition of interconnection with the load and line stabs 126L, 126A, 126R and 128L, 128A, 126R. There may be also provided adequate support for the bus system such as is shown at 137Y and 137X (FIG. 3).

In a embodiment of the invention, four line terminals (FIG. 5) may be segregated into four busses 124R, 124L, 124A and 124C for a four-pole circuit breaker. The two inner or central bus conductors 124A and 124C are joined together at common stab 128A (FIG. 5) for overlapping two central poles of a four-pole circuit breaker system. Likewise on the load side, the three load bus conductors 122, 122L and 122R are provided for interconnection with the four-pole circuit breaker at stabs 126A, 126L and 126R respectively. Stab 126A overlaps both the internal poles of the four-pole circuit breaker system but terminates in a single vertical riser or load bus portion 122 for interconnection with central load terminal 135A.

It is to be understood that teachings of the present invention are not limited to four-pole circuit breaker systems. The teachings may be utilized on any multi-pole breaker system were it is necessary to convert from a larger number of circuit breaker poles to a smaller number of line and load terminals or vice versa. It is also to be understood that particular design characteristics of the circuit breaker to be interconnected with network protector system are not limiting, nor is the circuit breaker system limited to use with a internal bussing arrangement having separate internal disconnect regions or the absence thereof.

The apparatus taught with respect to the embodiments of the present invention have many advantages. One advantages lies in the fact that conversion of a four-pole circuit breaker system for utilization in a three-pole network system can be accomplished in the internal bus ducting of the network protector system rather then requiring expensive, time consuming adjustments and modifications of the circuit breaker itself where there is precious little room for adding the material needed to accomplish the aforementioned purpose.

What we claim as our invention is:

1. A network protector, comprising;

an enclosure;

separate conductor means disposed within said enclosure;

n-pole circuit breaker means disposed within said enclosure, including n-terminals for interconnection with said separate conductor means;

said enclosure having n-1 external terminals for internal interconnection with said separate conductor means and external connection with electrical conductors external to said enclosure; and said separate conductor means having one conductor thereof which interconnects with two of said n-terminals of said circuit breaker means at one portion thereof and internally interconnects at another portion thereof with one of said n-1 external terminals of said enclosure.

2. The combination as claimed in claim 1, where n=4.

3. The combination as claimed in claim 2, wherein said four terminals of said circuit breaker are arranged as two end terminals and two inner terminals and said three external terminals are arranged as two outer terminals and one middle terminal, said two inner terminals of said circuit breaker being interconnected via said separate conductor means with said middle terminal of said three external terminals of said enclosure.

4. The combination as claimed in claim 3, wherein said circuit breaker is an AC circuit breaker.

* * * * *